US010714010B2

(12) United States Patent
Liu et al.

(10) Patent No.: US 10,714,010 B2
(45) Date of Patent: Jul. 14, 2020

(54) PIXEL COMPENSATION CIRCUIT, METHOD FOR DRIVING THE SAME, ORGANIC LIGHT-EMITTING DIODE DISPLAY PANEL, AND DISPLAY DEVICE

(71) Applicants: Beijing BOE Optoelectronics Technology Co., Ltd., Beijing (CN); BOE Technology Group Co., Ltd., Beijing (CN)

(72) Inventors: Ying Liu, Beijing (CN); Xin Wang, Beijing (CN); Xiaoping Zhang, Beijing (CN)

(73) Assignees: Beijing BOE Optoelectronics Technology Co., Ltd., Beijing (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 16/093,418

(22) PCT Filed: Apr. 2, 2018

(86) PCT No.: PCT/CN2018/081624
§ 371 (c)(1),
(2) Date: Oct. 12, 2018

(87) PCT Pub. No.: WO2018/184514
PCT Pub. Date: Oct. 11, 2018

(65) Prior Publication Data

US 2019/0130836 A1 May 2, 2019

(30) Foreign Application Priority Data

Apr. 7, 2017 (CN) ..... 2017 1 0224136

(51) Int. Cl.
*G09G 3/3258* (2016.01)
*G09G 3/3233* (2016.01)

(52) U.S. Cl.
CPC ..... *G09G 3/3258* (2013.01); *G09G 3/3233* (2013.01); *G09G 2300/0819* (2013.01);
(Continued)

(58) Field of Classification Search
CPC .. G09G 3/3258; G09G 3/3233; G09G 3/3225; G09G 2300/0819;
(Continued)

(56) References Cited

U.S. PATENT DOCUMENTS

2008/0224960 A1 9/2008 Le Roy et al.
2013/0069852 A1* 3/2013 Liao ..... G09G 3/3233 345/77

(Continued)

FOREIGN PATENT DOCUMENTS

CN 1898802 A 1/2007
CN 102290027 A 12/2011

(Continued)

OTHER PUBLICATIONS

International Search Report for PCT/CN2018/081624 dated Jun. 29, 2018.

(Continued)

*Primary Examiner* — Kent W Chang
*Assistant Examiner* — Andrew Lee
(74) *Attorney, Agent, or Firm* — Arent Fox LLP; Michael Fainberg

(57) ABSTRACT

Disclosed are a pixel compensation circuit, a method for driving the same, an organic light-emitting diode display panel, and a display device, and the pixel compensation circuit includes: a threshold compensation module, a storage module, a light-emission control module, a driver transistor, and a light-emitting diode, where the threshold compensation module is configured to provide a control electrode of the driver transistor with voltage of a data signal terminal, (Continued)

and threshold compensation voltage in a data writing stage; the storage module is configured to store the voltage of the control electrode of the driver transistor in the data writing stage and a light-emission stage; and the light-emission control module is configured to connect a second electrode of the driver transistor with the light-emitting diode in the light-emission stage to drive the light-emitting diode connected with the driver transistor to emit light.

11 Claims, 9 Drawing Sheets

(52) U.S. Cl.
CPC ..... *G09G 2300/0842* (2013.01); *G09G 2300/0861* (2013.01); *G09G 2320/045* (2013.01)

(58) Field of Classification Search
CPC ... G09G 2300/0842; G09G 2300/0861; G09G 2320/045
See application file for complete search history.

(56) References Cited

U.S. PATENT DOCUMENTS

| | | | | |
|---|---|---|---|---|
| 2015/0194092 | A1 | 7/2015 | Ma | |
| 2016/0196783 | A1* | 7/2016 | Hu | G09G 3/3233 345/690 |
| 2017/0061868 | A1* | 3/2017 | Tseng | G09G 3/3233 |
| 2017/0169761 | A1 | 7/2017 | Ma | |
| 2017/0206839 | A1 | 7/2017 | Wu et al. | |
| 2018/0130412 | A1 | 5/2018 | Zhang et al. | |
| 2018/0151123 | A1* | 5/2018 | Li | H01L 51/5203 |

FOREIGN PATENT DOCUMENTS

| | | | |
|---|---|---|---|
| CN | 102542977 | A | 7/2012 |
| CN | 102629447 | A | 8/2012 |
| CN | 103440846 | A | 12/2013 |
| CN | 104217682 | A | 12/2014 |
| CN | 204117568 | U | 1/2015 |
| CN | 104680968 | A | 6/2015 |
| CN | 104821150 | A | 8/2015 |
| CN | 104835452 | A | 8/2015 |
| CN | 106409225 | A | 2/2017 |
| CN | 106935197 | A | 7/2017 |
| EP | 1220191 | A2 | 7/2002 |
| KR | 20090122699 | A | 12/2009 |

OTHER PUBLICATIONS

Office Action for 201710224136.4 dated Aug. 1, 2018.
Office Action for 201710224136.4 dated Nov. 5, 2018.

* cited by examiner

PIXEL COMPENSATION CIRCUIT, METHOD FOR DRIVING THE SAME, ORGANIC LIGHT-EMITTING DIODE DISPLAY PANEL, AND DISPLAY DEVICE

This application is a National Stage of International Application No. PCT/CN2018/081624, filed Apr. 2, 2018, which claims the benefit of Chinese Patent Application No. 201710224136.4, filed with the Chinese Patent Office on Apr. 7, 2017, and entitled "A pixel compensation circuit, a method for driving the same, an organic light-emitting diode display panel, and a display device", both of which are hereby incorporated by reference in their entireties.

FIELD

This disclosure relates to the field of display technologies, and particularly to a pixel compensation circuit, a method for driving the same, an organic light-emitting diode display panel, and a display device.

BACKGROUND

An Organic Light-Emitting Diode (OLED) is one of focuses in the field of researches on flat panel displays, and the OLED display has low energy consumption, a low production cost, self-luminescence, a wide angle of view, a high response speed, and other advantages as compared with a Liquid Crystal Display (LCD); and at present, the OLED display has come to take the place of the traditional LCD in the field of displays of mobile phones, digital cameras, etc., where the design of a pixel compensation circuit for controlling a light-emitting diode to emit light is a core technology in the OLED display, so a research thereon is of significance.

SUMMARY

Embodiments of this disclosure relate to a pixel compensation circuit, a method for driving the same, an organic light-emitting diode display panel, and a display device in the following solutions:

An embodiment of this disclosure provides a pixel compensation circuit including: a threshold compensation module, a storage module, a light-emission control module, a driver transistor, and a light-emitting element, wherein:

the threshold compensation module is connected respectively with a data signal terminal, a scan signal terminal, and a control electrode of the driver transistor, and configured to provide the control electrode of the driver transistor with voltage of the data signal terminal, and threshold compensation voltage under the control of the scan signal terminal, wherein the difference between the threshold compensation voltage, and threshold voltage of the driver transistor lies in a preset range;

the storage module is connected respectively with the control electrode of the driver transistor, and a first power supply terminal, and configured to store voltage of the control electrode of the driver transistor; and the light-emission control module is connected respectively with a light-emission control signal terminal, a second electrode of the driver transistor, and the light-emitting element, and a first electrode of the driver transistor is connected with the first power supply terminal; and the light-emission control module is configured to connect the second electrode of the driver transistor with the light-emitting element under the control of the light-emission control signal terminal so that the driver transistors drives the light-emitting element to emit light.

Optionally, in the pixel compensation circuit above according to the embodiment of this disclosure, the threshold compensation voltage is equal to the threshold voltage of the driver transistor.

Optionally, in the pixel compensation circuit above according to the embodiment of this disclosure, the threshold compensation module includes: a compensation sub-module and a transmission sub-module, wherein:

the compensation sub-module is connected respectively with the data signal terminal and the transmission sub-module, and configured to provide the transmission sub-module with the voltage of the data signal terminal, and the threshold compensation voltage; and the transmission sub-module is further connected respectively with the scan signal terminal, and the control electrode of the driver transistor, and configured to transmit the voltage provided by the compensation sub-module to the control electrode of the driver transistor under the control of the scan signal terminal.

Optionally, in the pixel compensation circuit above according to the embodiment of this disclosure, the compensation sub-module includes: a threshold compensation transistor, wherein threshold voltage of the threshold compensation transistor is equal to the threshold compensation voltage; and the threshold compensation transistor includes a control electrode and a first electrode both of which are connected with the data signal terminal, and a second electrode connected with the transmission sub-module.

Optionally, in the pixel compensation circuit above according to the embodiment of this disclosure, the threshold compensation transistor and the drive transistor are P-type transistors or N-type transistors.

Optionally, in the pixel compensation circuit above according to the embodiment of this disclosure, the threshold compensation transistor is arranged adjacent to the driver transistor.

Optionally, in the pixel compensation circuit above according to the embodiment of this disclosure, a size of the threshold compensation transistor is same as that of the driver transistor.

Optionally, in the pixel compensation circuit above according to the embodiment of this disclosure, the transmission sub-module includes: a first switch transistor, wherein the first switch transistor includes a control electrode connected with the scan signal terminal, a first electrode connected with the compensation sub-module, and a second electrode connected with the control electrode of the driver transistor.

Optionally, in the pixel compensation circuit above according to the embodiment of this disclosure, the storage module includes: a capacitor, wherein the capacitor includes a first terminal connected with the first power supply terminal, and a second terminal connected with the control electrode of the driver transistor.

Optionally, in the pixel compensation circuit above according to the embodiment of this disclosure, the light-emission control module includes: a second switch transistor, wherein the second switch transistor includes a control electrode connected with the light-emission control signal terminal, a first electrode connected with the second electrode of the driver transistor, and a second electrode connected with a first terminal of the light-emitting element, and the second terminal of the light-emitting element is connected with a second power supply terminal.

Correspondingly, an embodiment of this disclosure provides an organic light-emitting diode display panel including the pixel compensation circuit according to any one of the embodiments above of this disclosure.

Correspondingly, an embodiment of this disclosure provides a display device including the organic light-emitting diode display panel above according to the embodiment of this disclosure.

Correspondingly, an embodiment of this disclosure provides a method for driving the pixel compensation circuit according to any one of the embodiments above of this disclosure, the method including: a data writing stage and a light emission stage, wherein:

in the data writing stage, providing, by the threshold compensation module, the control electrode of the driver transistor with the voltage of the data signal terminal and the threshold compensation voltage under the control of the scan signal terminal; and storing, by the storage module, the voltage of the control electrode of the driver transistor; and in the light emission stage, storing, by the storage module, the voltage of the control electrode of the driver transistor; and connecting, by the light-emission control module, the second electrode of the driver transistor with the light-emitting element under the control of the light-emission control signal terminal so that the driver transistors drives the light-emitting element to emit light.

DETAILED DESCRIPTION OF THE EMBODIMENTS

In order to make the objects, technical solutions, and advantages of this disclosure more apparent, particular implementations of the pixel compensation circuit, the method for driving the same, the organic light-emitting diode display panel, and the display device according to the embodiments of this disclosure will be described below in details with reference to the drawings. It shall be appreciated that the embodiments described below are only intended to illustrate and explain this disclosure, but not to limit this disclosure thereto. The embodiments of this disclosure, and the features in the embodiments can be combined with each other unless they conflict with each other.

Figure 1A:
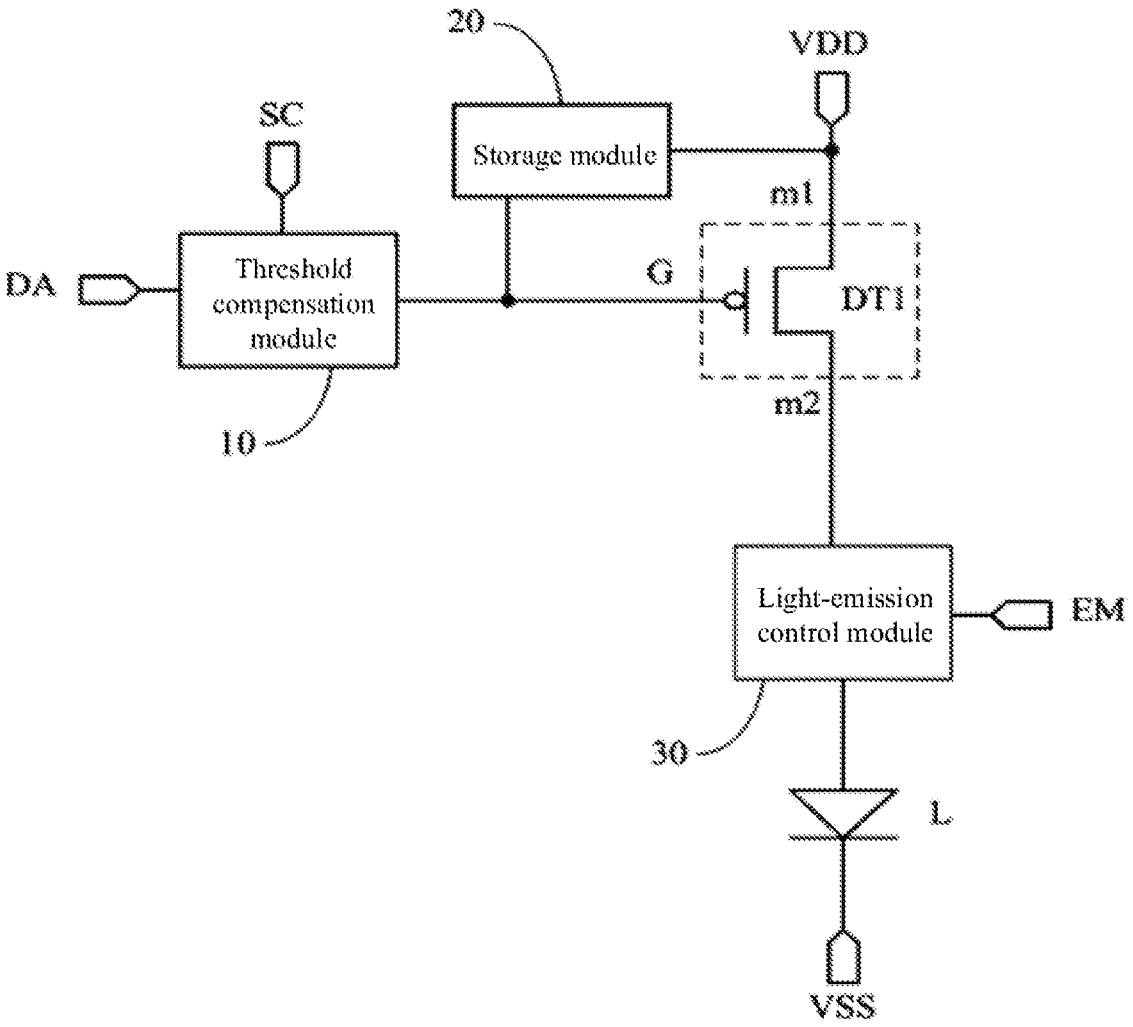
FIG. 1A is a schematic structural diagram of a pixel compensation circuit according to an embodiment of this disclosure.
Figure 1B:
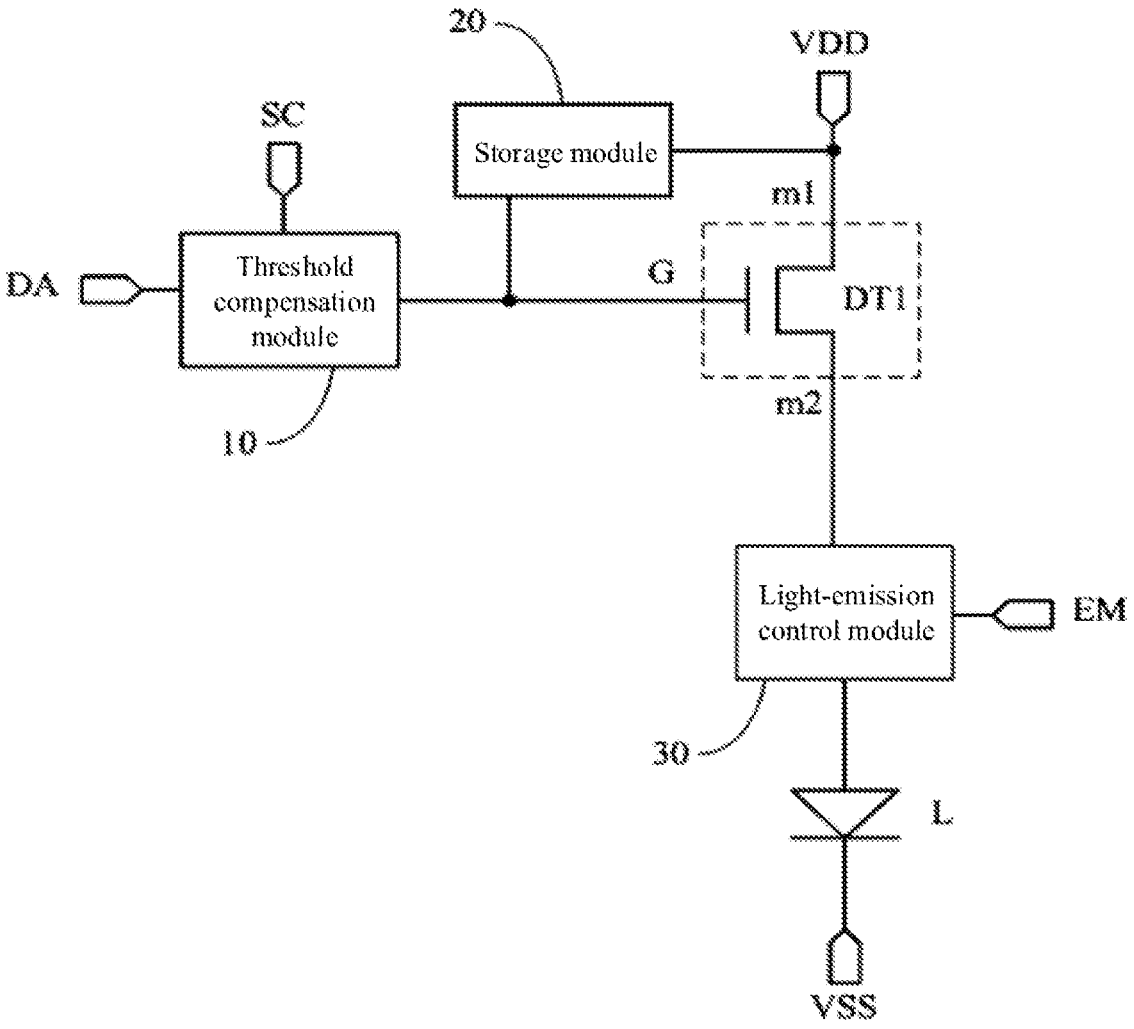
FIG. 1B is another schematic structural diagram of a pixel compensation circuit according to an embodiment of this disclosure.

An embodiment of this disclosure provides a pixel compensation circuit as illustrated in FIG. 1A and FIG. 1B including: a threshold compensation module 10, a storage module 20, a light-emission control module 30, a driver transistor DT1, and a light-emitting element L.

The threshold compensation module 10 is connected respectively with a data signal terminal DA, a scan signal terminal SC, and a control electrode G of the driver transistor DT1, and configured to provide the control electrode G of the driver transistor DT1 with voltage of the data signal terminal DA, and threshold compensation voltage under the control of the scan signal terminal SC, where the difference between the threshold compensation voltage, and threshold voltage of the driver transistor lies in a preset range.

The storage module 20 is connected respectively with the control electrode G of the driver transistor DT1, and a first power supply terminal VDD, and configured to store the voltage of the control electrode G of the driver transistor DT1.

The light-emission control module 30 is connected respectively with a light-emission control signal terminal EM, a second electrode m2 of the driver transistor DT1, and the light-emitting element L, and a first electrode m1 of the driver transistor DT1 is connected with the first power supply terminal VDD; and the light-emission control module 30 is configured to connect the second electrode m2 of the driver transistor DT1 with the light-emitting element L under the control of the light-emission control signal terminal EM to drive the light-emitting element L connected with the driver transistor DT1 to emit light.

The pixel compensation circuit above according to the embodiment of this disclosure includes: the threshold compensation module, the storage module, the light-emission control module, the driver transistor, and the light-emitting diode, where the threshold compensation module is configured to provide the control electrode of the driver transistor with the voltage of the data signal terminal, and the threshold compensation voltage in a data writing stage; the storage module is configured to store the voltage of the control electrode of the driver transistor in the data writing stage and a light-emission stage; and the light-emission control module is configured to connect the second electrode of the driver transistor with the light-emitting diode in the light-emission stage to drive the light-emitting diode connected with the driver transistor to emit light. Accordingly in the pixel compensation circuit above according to the embodiment of this disclosure, the three modules above can cooperate with each other to compensate for the threshold voltage of the driver transistor using a simple structure, simple timing, and a small number of signal lines so as to simplify a fabrication process, to lower a production cost, and to reduce an occupied area, thus facilitating a design of the OLED display panel with high resolution.

It shall be noted that in the pixel compensation circuit above according to the embodiment of this disclosure, the preset range is an error allowable range. The smaller the difference between the threshold compensation voltage and threshold voltage of the driver transistor is, the more effective compensation the threshold voltage of the driver transistor has. Therefore, optionally the threshold compensation voltage is equal to the threshold voltage of the driver transistor.

Optionally, in the pixel compensation circuit above according to the embodiment of this disclosure, as illustrated in FIG. 1A, the driver transistor DT1 can be a P-type transistor. The P-type transistor has a gate which is the control electrode G of the driver transistor DT1, a source which is the first electrode m1 of the driver transistor DT1, and a drain which is the second electrode p2 of the driver transistor DT1. At this time, operating current to drive the light-emitting element L to emit light flows from the source of the P-type transistor to the drain thereof.

Alternatively, the driver transistor DT1 can be an N-type transistor. The N-type transistor has a gate which is the control electrode G of the driver transistor DT1, a drain which is the first electrode m1 of the driver transistor DT1, and a source which is the second electrode p2 of the driver transistor DT1. At this time, operating current to drive the light-emitting element L to emit light flows from the drain of the N-type transistor to the source thereof.

Figure 2A:
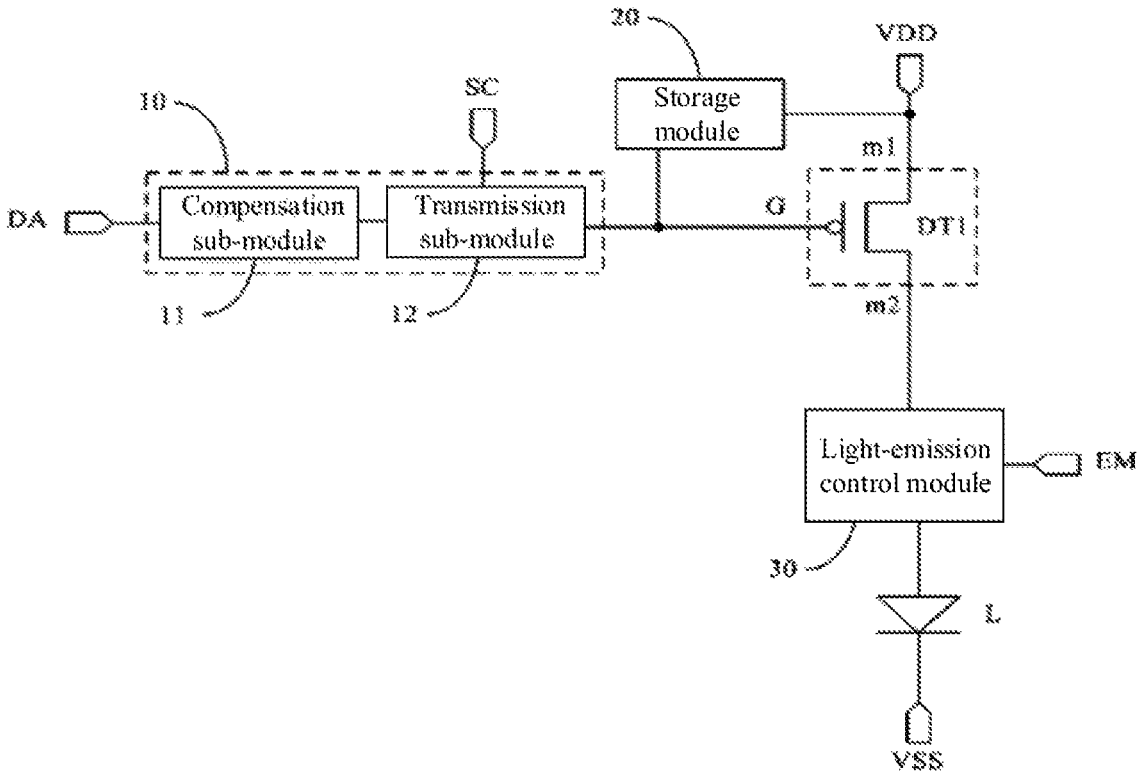
FIG. 2A is a further schematic structural diagram of a pixel compensation circuit according to an embodiment of this disclosure.
Figure 2B:
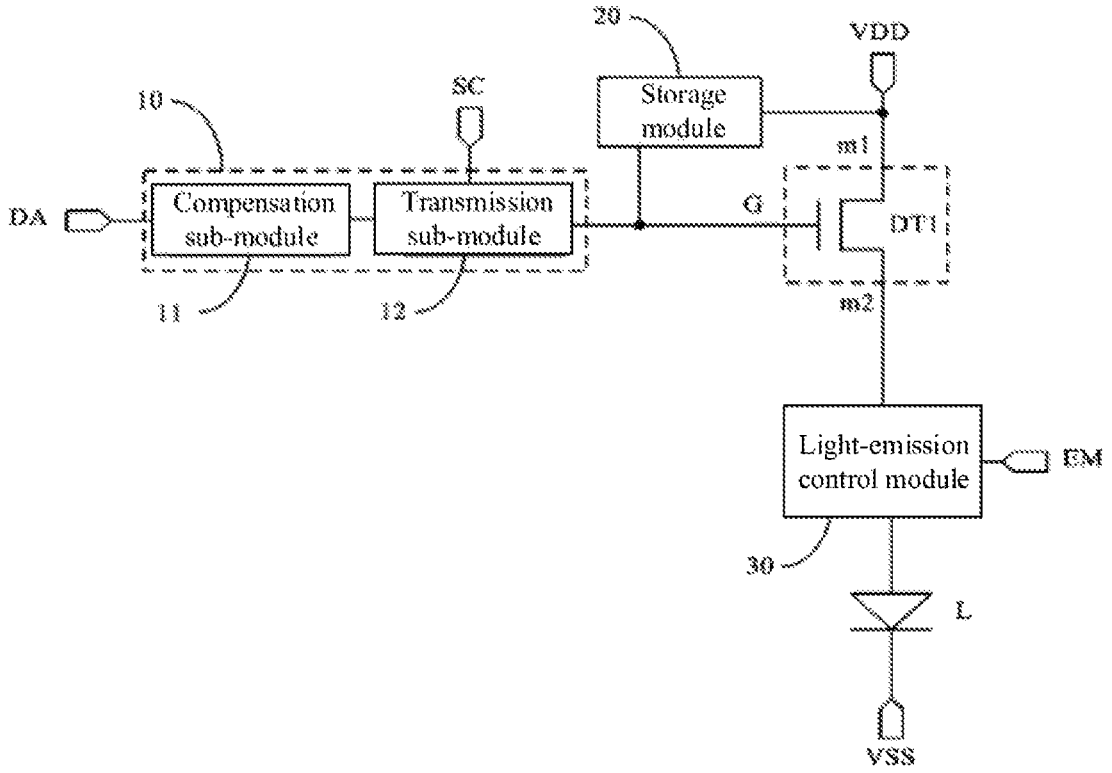
FIG. 2B is a further schematic structural diagram of a pixel compensation circuit according to an embodiment of this disclosure.

Optionally, in the pixel compensation circuit above according to the embodiment of this disclosure, as illustrated in FIG. 2A and FIG. 2B, the threshold compensation module 10 can include: a compensation sub-module 11 and a transmission sub-module 12.

The compensation sub-module 11 is connected respectively with the data signal terminal DA and the transmission sub-module 12, and configured to provide the transmission sub-module 12 with the voltage of the data signal terminal DA, and the threshold compensation voltage.

The transmission sub-module 12 is further connected respectively with the scan signal terminal SC, and the control electrode G of the driver transistor DT1, and configured to transmit the voltage provided by the compensation sub-module 11 to the control electrode G of the driver transistor DT1 under the control of the scan signal terminal SC.

Optionally, in the pixel compensation circuit above according to the embodiment of this disclosure, the voltage $V_{data}$ of the data signal terminal DA, and the threshold voltage $V_{th}$(DT1) of the drive transistor satisfy the equation of $V_{data}>|V_{th}(DT1)|$.

The disclosure will be described below in details in connection with a particular embodiment thereof. It shall be noted that this embodiment is intended to better illustrate the disclosure, but not to limit the disclosure thereto.

Optionally, in the pixel compensation circuit above according to the embodiment of this disclosure, as illustrated in FIG. 3A to FIG. 4B, the compensation sub-module 11 can include: a threshold compensation transistor DT2, where threshold voltage of the threshold compensation transistor DT2 is equal to the threshold compensation voltage; and the threshold compensation transistor DT2 has a control electrode and a first electrode both of which are connected with the data signal terminal DA, and a second electrode connected with the transmission sub-module 12.

Figure 3A:
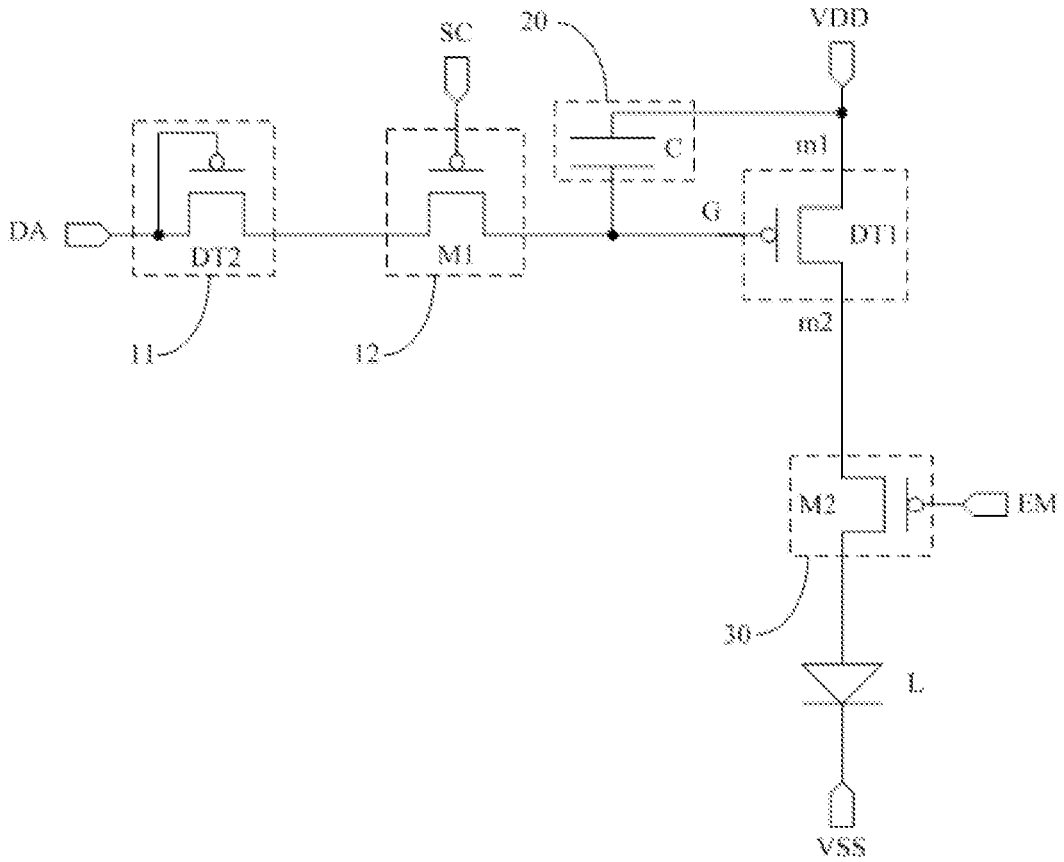
FIG. 3A is a schematic structural diagram of details of the pixel compensation circuit as illustrated in FIG. 2A.
Figure 3B:
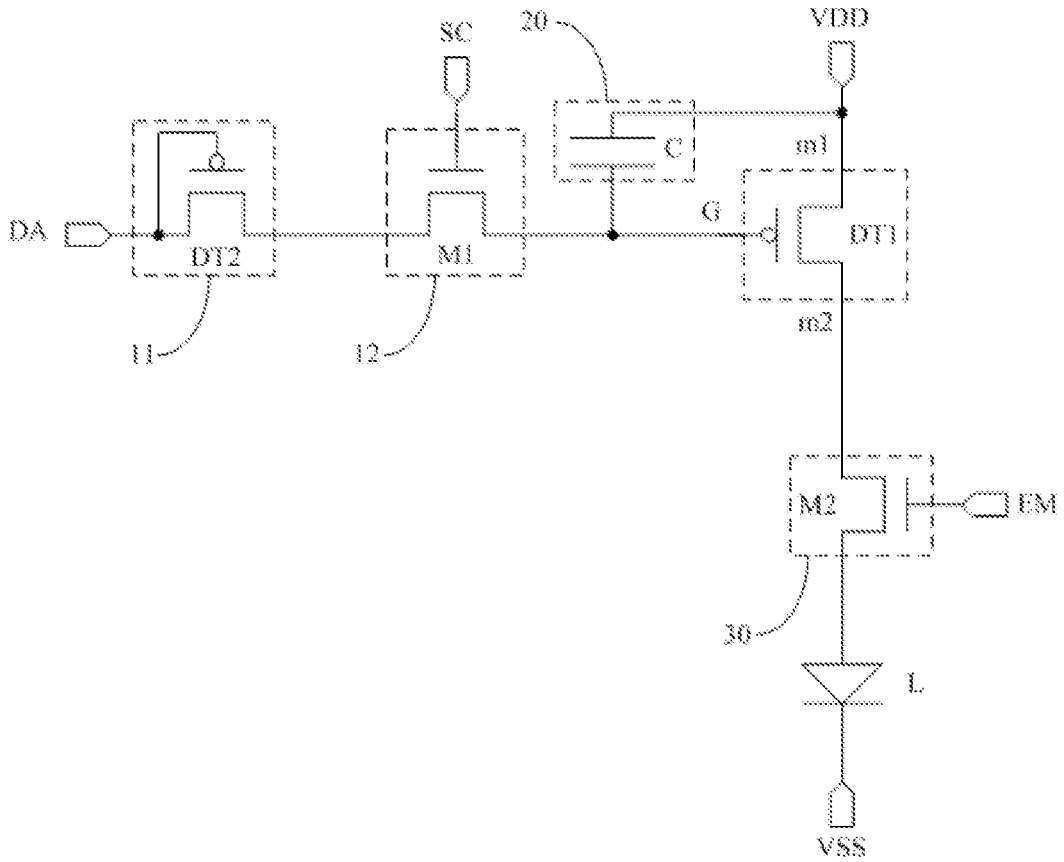
FIG. 3B is another schematic structural diagram of details of the pixel compensation circuit as illustrated in FIG. 2A.
Figure 4A:
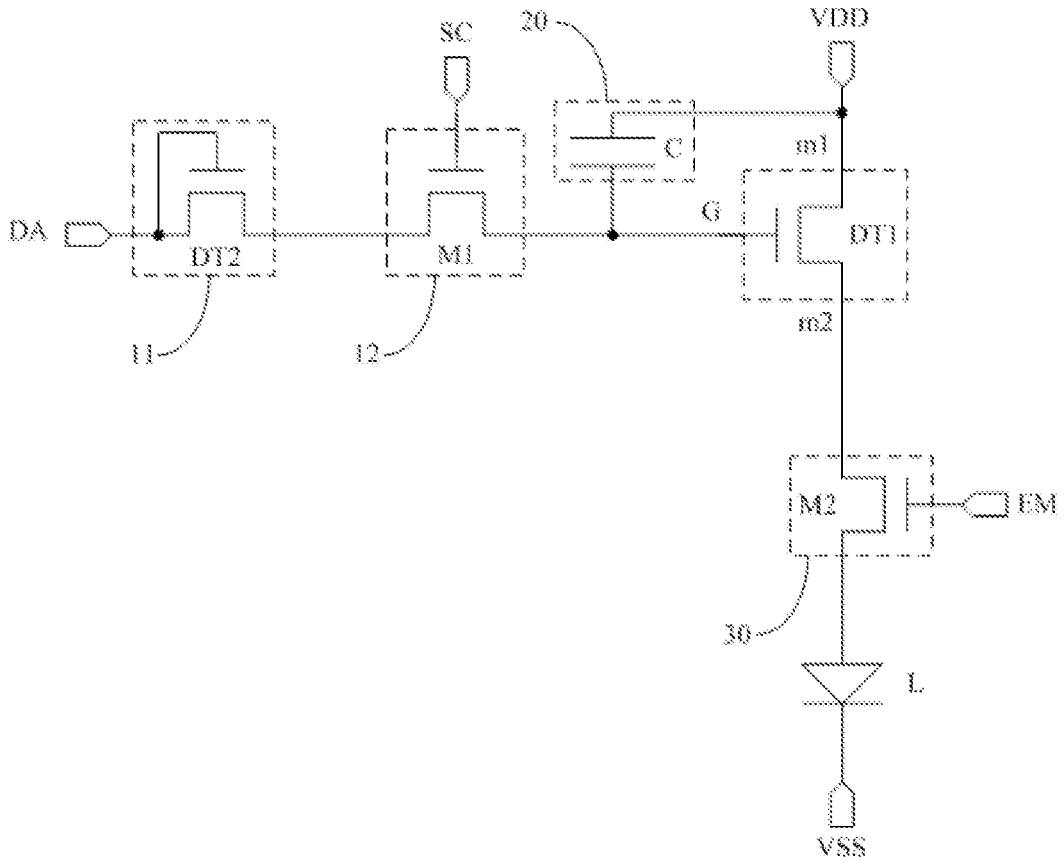
FIG. 4A is a schematic structural diagram of details of the pixel compensation circuit as illustrated in FIG. 2B.
Figure 4B:
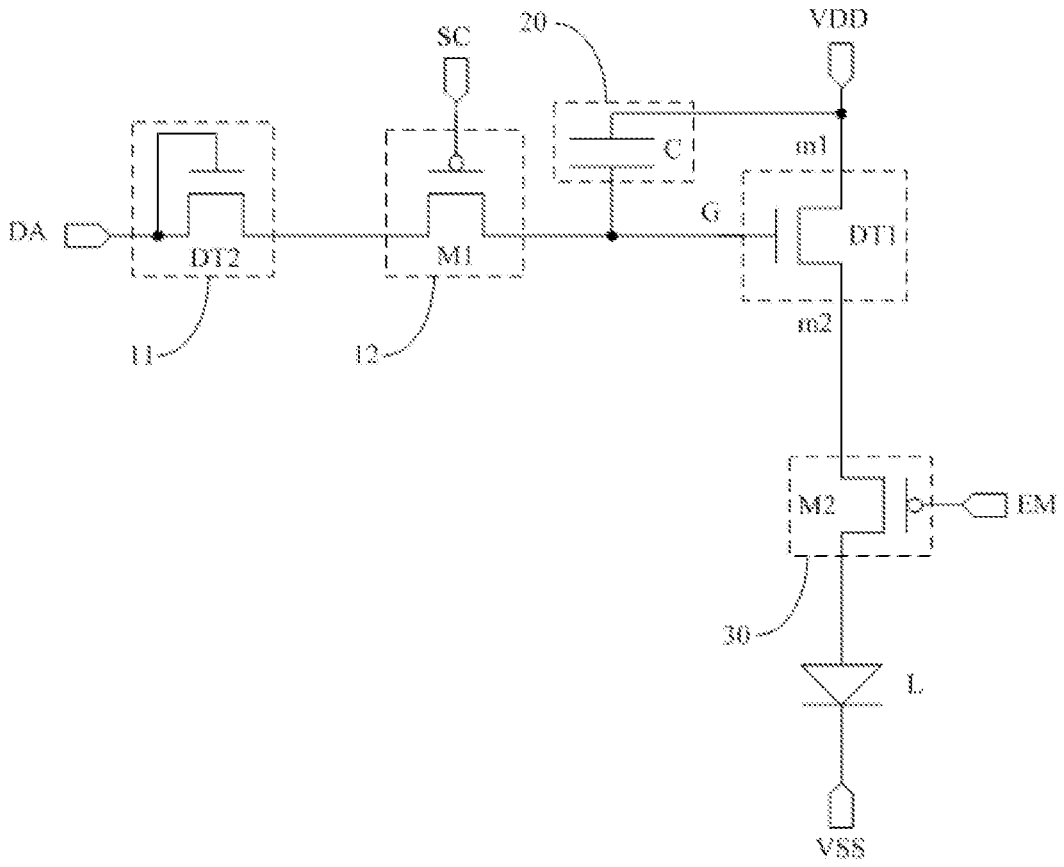
FIG. 4B is another schematic structural diagram of details of the pixel compensation circuit as illustrated in FIG. 2B.

Optionally, in the pixel compensation circuit above according to the embodiment of this disclosure, as illustrated in FIG. 3A and FIG. 3B, the threshold compensation transistor DT2 can be a P-type transistor. The P-type transistor has a gate which is the control electrode of the threshold compensation transistor DT2, a source which is the first electrode of the threshold compensation transistor DT2, and a drain which is the second electrode of the threshold compensation transistor DT2. At this time, current of the signal of the data signal terminal DA flows from the source of the P-type transistor to the drain thereof. Alternatively, as illustrated in FIG. 4A and FIG. 4B, the threshold compensation transistor DT2 can be an N-type transistor. The N-type transistor has a gate which is the control electrode of the threshold compensation transistor DT2, a source which is the second electrode of the threshold compensation transistor DT2, and a drain which is the first electrode of the threshold compensation transistor DT2. At this time, current of the signal of the data signal terminal DA flows from the drain of the P-type transistor to the source thereof.

Optionally, a transistor characteristic, e.g., the threshold voltage, of the threshold compensation transistor DT2 is the same as that of the driver transistor DT1 in an error allowable range. In a real fabrication process, an arrangement position of the threshold compensation transistor DT2 can be designed proximate to that of the driver transistor DT1, and the size of the threshold compensation transistor DT2 can be set the same as that of the driver transistor DT1, so that their transistor characteristics are the same in the error allowable range. Furthermore in a real application, the characteristics of the threshold compensation transistor DT2 and the driver transistor DT1 shall be designed as needed in a real application environment, although the embodiment of this disclosure will not be limited to any particular characteristics thereof.

Optionally, in the pixel compensation circuit above according to the embodiment of this disclosure, the threshold compensation transistor DT2 is arranged adjacent to the driver transistor DT1, and the size of the threshold compensation transistor DT2 is same as that of the driver transistor DT1.

Optionally, in the pixel compensation circuit above according to the embodiment of this disclosure, the control electrode and the first electrode of the threshold compensation transistor is connected with the data signal terminal in a diode pattern, so when the data voltage $V_{data}$ of the data signal terminal is active for displaying in the data writing stage, the threshold compensation transistor is switched on, and inputs a signal to the transmission sub-module until the voltage of the second electrode of the threshold compensation transistor is changed to $V_{data}-|V_{th}(DT2)|$, and then the threshold compensation transistor is switched off, where $V_{th}$(DT2) is the threshold voltage of the threshold compensation transistor. Since $V_{th}$(DT2) is equal to the threshold voltage $V_{th}$(DT1) of the driver transistor, the threshold compensation transistor can provide the transmission sub-module with the voltage of the data signal terminal, and voltage being equal to the threshold voltage of the driver transistor.

Optionally, in the pixel compensation circuit above according to the embodiment of this disclosure, as illustrated in FIG. 3A to FIG. 4B, the transmission sub-module 12 can include: a first switch transistor M1.

The first switch transistor M1 has a control electrode connected with the scan signal terminal SC, a first electrode connected with the compensation sub-module 11, and a second electrode connected with the control electrode G of the driver transistor DT1.

Optionally, in the pixel compensation circuit above according to the embodiment of this disclosure, as illustrated in FIG. 3A and FIG. 4B, the first switch transistor M1 can be a P-type transistor; or as illustrated in FIG. 3B and FIG. 4A, the first switch transistor M1 can be an N-type transistor, although the embodiment of this disclosure will not be limited thereto.

Optionally, in the pixel compensation circuit above according to the embodiment of this disclosure, when the first switch transistor M1 is switched on under the control of the scan signal terminal SC, it can provide the control electrode G of the driver transistor DT1 with the voltage of the first electrode thereof, i.e., the voltage output by the compensation sub-module.

Optionally, in the pixel compensation circuit above according to the embodiment of this disclosure, as illustrated in FIG. 3A to FIG. 4B, the light-emission control module 30 can include: a second switch transistor M2.

The second switch transistor M2 has a control electrode connected with the light-emission control signal terminal EM, a first electrode connected with the second electrode m2 of the driver transistor DT1, and a second electrode connected with a first terminal of the light-emitting element L, and the second terminal of the light-emitting element L is connected with a second power supply terminal VSS.

Optionally, in the pixel compensation circuit above according to the embodiment of this disclosure, as illustrated in FIG. 3A and FIG. 4B, the second switch transistor can be a P-type transistor; or as illustrated in FIG. 3B and FIG. 4A, the second switch transistor can be an N-type transistor, although the embodiment of this disclosure will not be limited thereto.

Optionally, in the pixel compensation circuit above according to the embodiment of this disclosure, when the second switch transistor M2 is switched on under the control of the light-emission control signal terminal, the second electrode of the driver transistor DT1 is connected with the first terminal of the light-emitting element L so that current output by the second electrode of the driver transistor DT1 is provided to the light-emitting element L to drive the light-emitting element L to emit light.

Optionally, in the pixel compensation circuit above according to the embodiment of this disclosure, as illustrated in FIG. 3A to FIG. 4B, the storage module 20 can include: a capacitor C, where the capacitor C has a first terminal connected with the first power supply terminal VDD, and a second terminal connected with the control electrode G of the driver transistor DT1.

Optionally, in the pixel compensation circuit above according to the embodiment of this disclosure, the capacitor can be charged under the control of the first power supply terminal VDD, and the control electrode of the driver transistor DT1, and while the control electrode of the driver transistor DT1 is floating due to the bootstrapping capacitor C, a stable difference in voltage across the capacitor can be maintained so that charged voltage is stored.

Optionally, in the pixel compensation circuit above according to the embodiment of this disclosure, the voltage $V_{dd}$ of the first power supply terminal VDD is higher than the voltage $V_{ss}$ of the second power supply terminal VSS.

Optionally, in the pixel compensation circuit above according to the embodiment of this disclosure, the light-emitting element L is typically an organic light-emitting diode which emits light under the action of the current of the driver transistor DT1 in a saturated state. Furthermore, the organic light-emitting diode has an anode which is the first terminal of the light-emitting element L, and a cathode which is the second terminal of the light-emitting element L.

Structures of the respective modules in the pixel compensation circuit according to the embodiment of this disclosure has only been described above by way of an example, and optionally the particular structures of the respective modules above will not be limited to the structures above according to the embodiment of this disclosure, but can alternatively be other structures which can occur to those skilled in the art, so the embodiment of this disclosure will not be limited thereto.

Furthermore, in order to simplify a fabrication process, optionally in the pixel compensation circuit above according to the embodiment of this disclosure, as illustrated in FIG. 3A, the driver transistor DT1 is a P-type transistor, the threshold compensation transistor DT2 is a P-type transistor, and all the switch transistors are P-type transistors. Alternatively, as illustrated in FIG. 4A, the driver transistor DT1 is an N-type transistor, the threshold compensation transistor DT2 is an N-type transistor, and all the switch transistors are N-type transistors.

Optionally, in the pixel compensation circuit above according to the embodiment of this disclosure, a P-type transistor is switched off at a high level, and switched on at a low level; and an N-type transistor is switched off at a low level, and switched on at a high level.

It shall be noted that in the pixel compensation circuit above according to the embodiment of this disclosure, the driver transistor and the switch transistors can be Thin Film Transistors (TFTs), or can be Metal Oxide Semiconductor (MOS) field-effect transistors, although the embodiment of this disclosure will not be limited thereto. In an optional implementation, the control electrodes of these switch transistors can be gates, and their first electrodes can be sources or drains, while their second electrodes can be drains or sources, dependent upon their different types and signals of the signal terminals, although the embodiment of this disclosure will not be limited thereto. The particular embodiments have been and will be described by way of an example in which the drive although the driver transistor and the switch transistors are MOS transistors.

An operating process of the pixel compensation circuit above according to the embodiment of this disclosure will be described below in connection with a circuit timing diagram taking the pixel compensation circuits as illustrated in FIG. 3A and FIG. 4A as an example. In the following description, 1 represents a high level, and 0 represents a low level. It shall be noted that 1 and 0 are logic levels, and only intended to better explain the particular operating process of the pixel compensation circuit according to the embodiment of this disclosure.

Figure 5A:
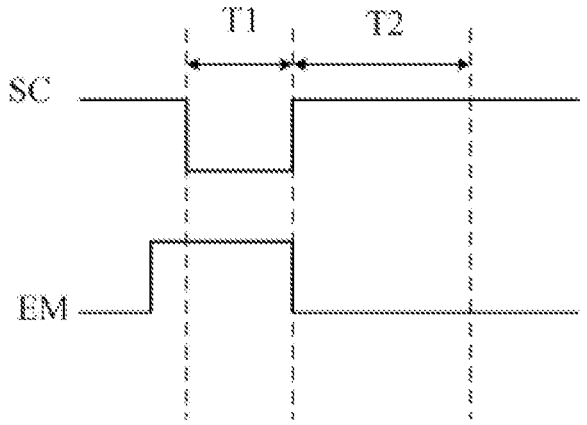
FIG. 5A is a timing diagram of the pixel compensation circuit as illustrated in FIG. 3A.

In an optional embodiment, as illustrated in FIG. 3A, the driver transistor DT1, the threshold compensation transistor DT2, and all the switch transistors are P-type transistors; and FIG. 5A illustrates a corresponding input timing diagram. Optionally, there are two selected stages T1 and T2 in the input timing diagram as illustrated in FIG. 5A.

In the T1 stage, SC=0, and EM=1. With SC=0, the first switch transistor M1 is switched on. With EM=1, the second switch transistor M2 is switched off.

Since both the gate and the source of the threshold compensation transistor DT2 are connected with the data signal terminal DA in a diode pattern, the threshold compensation transistor DT2 is switched on under the action of the data voltage $V_{data}$ of the data signal terminal DA until the voltage of the drain of the threshold compensation transistor DT2 is changed to $V_{data}-|V_{th}(DT2)|$, and then the threshold compensation transistor D2 is switched off. The first switch transistor M1 which is switched on provides the gate G of the driver transistor DT1 with the voltage $V_{data}-|V_{th}(DT2)|$ of the drain of the threshold compensation transistor DT2 so that the voltage of the gate of the driver transistor DT1 is $V_{data}-|V_{th}(DT2)|$, and the capacitor C is charge so that the difference in voltage across the capacitor C is $V_{dd}-V_{data}+|V_{th}(DT2)|$.

In the stage T2, SC=1, and EM=0. With SC=1, the first switch transistor M1 is switched off. With EM=0, the second switch transistor M2 is switched on.

The second switch transistor M2 which is switched on connects the drain D of the driver transistor DT1 with the light-emitting element L to provide the light-emitting element L with the current of the drain of the driver transistor DT1. The current $I_L$ of the drain of the driver transistor DT1 is current thereof in a saturated state, and as can be apparent from the characteristic of the current in the saturated state, the current $I_L$ satisfies the equation of:

$$I_L = K(V_{GS} - |V_{th}(DT0)|)^2 = K(V_{dd} - V_{data} + V_{th}(DT2) - |V_{th}(DT0)|) = K(V_{dd} - V_{data}), \quad \text{where } K = \mu C_{ox}\frac{W}{L},$$

μ is the mobility of the driver transistor DT1, $C_{ox}$ is a capacitance of a gate oxide layer in a unit of area, $$\frac{W}{L}$$

is a width to length ratio of the driver transistor, $V_{GS}$ is the difference in voltage between the gate of the driver transistor DT1, and the source thereof, and $V_{th}(DT2)=V_{th}(DT1)$. Accordingly the operating current $I_L$ of the driver transistor DT1 to drive the light-emitting element L to emit light is only dependent upon the voltage $V_{data}$ of the data signal terminal DA, and the voltage $V_{dd}$ of the first power supply terminal VDD, and independent of the threshold voltage $V_{th}(DT1)$ of the driver transistor DT1, so that the operating current driving the light-emitting element L can be avoided from being affected by the threshold voltage $V_{th}(DT1)$ drifting due to a process of fabricating the driver transistor DT1, and a long operating period of time thereof, to thereby maintain the stable operating current of the light-emitting element L so s to enable the light-emitting element L to operate normally.

Figure 5B:
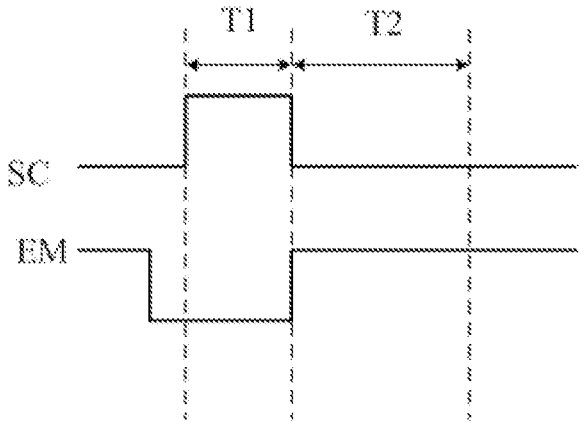
FIG. 5B is a timing diagram of the pixel compensation circuit as illustrated in FIG. 4A.

In another embodiment, as illustrated in FIG. 4A, the driver transistor DT1, the threshold compensation transistor DT2, and all the switch transistors are N-type transistors; and FIG. 5B illustrates a corresponding input timing diagram. There are two selected stages T1 and T2 in the input timing diagram as illustrated in FIG. 5A.

In the T1 stage, SC=1, and EM=0. With SC=1, the first switch transistor M1 is switched on. With EM=1, the second switch transistor M2 is switched off.

Since both the gate and the drain of the threshold compensation transistor DT2 are connected with the data signal terminal DA in a diode pattern, the threshold compensation transistor DT2 is switched on under the action of the data voltage $V_{data}$ of the data signal terminal DA until the voltage of the source of the threshold compensation transistor DT2 is changed to $V_{data}-|V_{th}(DT2)|$, and then the threshold compensation transistor D2 is switched off. The first switch transistor M1 which is switched on provides the gate G of the driver transistor DT1 with the voltage $V_{data}-|V_{th}(DT2)|$ of the source of the threshold compensation transistor DT2 so that the voltage of the gate of the driver transistor DT1 is $V_{data}-|V_{th}(DT2)|$, and the capacitor C is charge so that the difference in voltage across the capacitor C is $V_{dd}-V_{data}+|V_{th}(DT2)|$.

In the stage T2, SC=0, and EM=1. With SC=0, the first switch transistor M1 is switched off. With EM=0, the second switch transistor M2 is switched on.

The second switch transistor M2 which is switched on connects the source S of the driver transistor DT1 with the light-emitting element L to provide the light-emitting element L with the current of the source of the driver transistor DT1. The current $I_L$ of the source of the driver transistor DT1 is current thereof in a saturated state, and as can be apparent from the characteristic of the current in the saturated state, the current $I_L$ satisfies the equation of:

$$I_L = K(V_{GS} - |V_{th}(DT0)|)^2 = K(V_{dd} - V_{data} + V_{th}(DT2) - |V_{th}(DT0)|) = K(V_{dd} - V_{data}), \quad \text{where } K = \mu C_{ox}\frac{W}{L},$$

μ is the mobility of the driver transistor DT1, $C_{ox}$, is a capacitance of a gate oxide layer in a unit of area, $$\frac{W}{L}$$

is a width to length ratio of the driver transistor, $V_{GS}$ is the difference in voltage between the gate of the driver transistor DT1, and the drain thereof, and $V_{th}(DT2)=V_{th}(DT1)$. Accordingly the operating current $I_L$ of the driver transistor DT1 to drive the light-emitting element L to emit light is only dependent upon the voltage $V_{data}$ of the data signal terminal DA, and the voltage $V_{dd}$ of the first power supply terminal VDD, and independent of the threshold voltage $V_{th}(DT1)$ of the driver transistor DT1, so that the operating current driving the light-emitting element L can be avoided from being affected by the threshold voltage $V_{th}(DT1)$ drifting due to a process of fabricating the driver transistor DT1, and a long operating period of time thereof, to thereby maintain the stable operating current of the light-emitting element L so as to enable the light-emitting element L to operate normally.

The pixel compensation circuit above according to the embodiment of this disclosure can perform the function of compensating the threshold voltage of the driver transistor using a simple structure, i.e., the two switch transistors, the capacitor, and the threshold compensation transistor with the same threshold voltage as that of the driver transistor, and simple timing, to thereby simplify the fabrication process, lower the production cost, and reduce the occupied area so as to facilitate the design of the OLED display panel with high resolution. Furthermore, as compared with the existing pixel compensation circuit, a switch transistor and a signal terminal for initializing the gate of the driver transistor will not be additionally arranged in the pixel compensation circuit according to the embodiment of this disclosure, to thereby lower a driving capacity required of a driving IC (e.g., a scan driving circuit) so as to reduce the sizes of transistors in the driving IC, and to narrow an occupied space of the driving IC, thus further narrowing a bezel of a display panel. Furthermore, since the pixel compensation circuit according to the embodiment of this disclosure at least can further reduce the number of signal lines for inputting an initialization signal, the resolution of the display panel can be improved.

Figure 6:
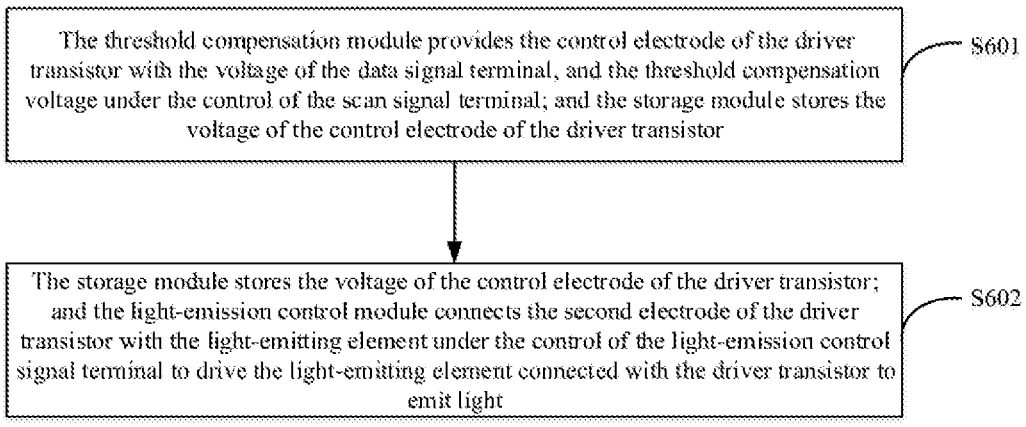
FIG. 6 is a flow chart of a driving method according to an embodiment of this disclosure.

Based upon the same inventive idea, an embodiment of this disclosure further provides a method for driving the pixel compensation circuit according to any one of the embodiments above of this disclosure, and as illustrated in FIG. 6, the method includes: a data writing stage and a light emission stage, where:

in the step S601, in the data writing stage, the threshold compensation module provides the control electrode of the driver transistor with the voltage of the data signal terminal, and the threshold compensation voltage under the control of the scan signal terminal; and the storage module stores the voltage of the control electrode of the driver transistor; and in the step S602, in the light emission stage, the storage module stores the voltage of the control electrode of the driver transistor; and the light-emission control module connects the second electrode of the driver transistor with the light-emitting element under the control of the light-emission control signal terminal to drive the light-emitting element connected with the driver transistor to emit light.

The driving method above according to the embodiment of this disclosure can perform the function of compensating the threshold voltage of the driver transistor using simple timing.

Optionally, in the driving method above according to the embodiment of this disclosure, in the data writing stage, the compensation sub-module provides the transmission sub-module with the voltage of the data signal terminal, and the threshold compensation voltage; and the transmission sub-module transmits the voltage provided by the compensation sub-module to the control electrode of the driver transistor.

Based upon the same inventive idea, an embodiment of this disclosure further provides an organic light-emitting diode display panel including the pixel compensation circuits according to any one of the embodiments above of this disclosure. The organic light-emitting diode display panel addresses the problem under a similar principle to that of the pixel compensation circuit above, so reference can be made to the implementation of the pixel compensation circuit above for a particular implementation of the organic light-emitting diode display panel, and a repeated description thereof will be omitted here.

Based upon the same inventive idea, an embodiment of this disclosure further provides a display device including the organic light-emitting diode display panel according to the embodiment above of this disclosure. The display device can be a mobile phone, a tablet computer, a TV set, a monitor, a notebook computer, a digital photo frame, a navigator, or any other product or component capable of displaying. Other components indispensable to the display device shall readily occur to those skilled in the art, so a repeated description thereof will be omitted here. Reference can be made to the embodiment of the organic light-emitting diode display panel above for an implementation of the display device, so a repeated description thereof will be omitted here.

The embodiments of this disclosure provide the pixel compensation circuit, the method for driving the same, the organic light-emitting diode display panel, and the display device, and the pixel compensation circuit includes: the threshold compensation module, the storage module, the light-emission control module, the driver transistor, and the light-emitting diode, where the threshold compensation module is configured to provide the control electrode of the driver transistor with the voltage of the data signal terminal, and the threshold compensation voltage in the data writing stage; the storage module is configured to store the voltage of the control electrode of the driver transistor in the data writing stage and the light-emission stage; and the light-emission control module is configured to connect the second electrode of the driver transistor with the light-emitting diode in the light-emission stage to drive the light-emitting diode connected with the driver transistor to emit light. Accordingly in the pixel compensation circuit above according to the embodiment of this disclosure, the three modules above can cooperate with each other to compensate for the threshold voltage of the driver transistor using a simple structure, simple timing, and a small number of signal lines so as to simplify a fabrication process, to lower a production cost, and to reduce an occupied area, thus facilitating a design of the OLED display panel with high resolution.

Evidently those skilled in the art can make various modifications and variations to the disclosure without departing from the spirit and scope of the disclosure. Accordingly the disclosure is also intended to encompass these modifications and variations thereto so long as the modifications and variations come into the scope of the claims appended to the disclosure and their equivalents.

The invention claimed is:

1. A pixel compensation circuit, comprising: a threshold compensation module, a storage module, a light-emission control module, a driver transistor, and a light-emitting element, wherein:

the threshold compensation module is connected respectively with a data signal terminal, a scan signal terminal, and a control electrode of the driver transistor, and configured to provide the control electrode of the driver transistor with voltage of the data signal terminal, and threshold compensation voltage under a control of the scan signal terminal, wherein a difference between the threshold compensation voltage and threshold voltage of the driver transistor lies in a preset range;

the storage module is connected respectively with the control electrode of the driver transistor, and a first power supply terminal, and configured to store the voltage of the control electrode of the driver transistor; and the light-emission control module is connected respectively with a light-emission control signal terminal, a second electrode of the driver transistor, and the light-emitting element, and a first electrode of the driver transistor is connected with the first power supply terminal; and the light-emission control module is configured to connect a second electrode of the driver transistor with the light-emitting element under a control of the light-emission control signal terminal so that the driver transistors drives the light-emitting element to emit light;

wherein the threshold compensation module comprises: a compensation sub-module and a transmission sub-module, wherein:

the compensation sub-module is connected respectively with the data signal terminal and the transmission sub-module, and configured to provide the transmission sub-module with the voltage of the data signal terminal, and the threshold compensation voltage; and the transmission sub-module is further connected respectively with the scan signal terminal and the control electrode of the driver transistor, and configured to transmit the voltage provided by the compensation sub-module to the control electrode of the driver transistor under the control of the scan signal terminal.

2. The pixel compensation circuit according to claim 1, wherein the threshold compensation voltage is equal to the threshold voltage of the driver transistor.

3. The pixel compensation circuit according to claim 1, wherein the compensation sub-module comprises: a threshold compensation transistor, wherein threshold voltage of the threshold compensation transistor is equal to the threshold compensation voltage; and the threshold compensation transistor comprises a control electrode and a first electrode both of which are connected with the data signal terminal, and a second electrode connected with the transmission sub-module.

4. The pixel compensation circuit according to claim 3, wherein the threshold compensation transistor and the drive transistor are P-type transistors or N-type transistors.

5. The pixel compensation circuit according to claim 3, wherein the threshold compensation transistor is arranged adjacent to the driver transistor.

6. The pixel compensation circuit according to claim 3, wherein a size of the threshold compensation transistor is same as that of the driver transistor.

7. The pixel compensation circuit according to claim 1, wherein the transmission sub-module comprises: a first switch transistor, wherein:

the first switch transistor comprises a control electrode connected with the scan signal terminal, a first electrode connected with the compensation sub-module, and a second electrode connected with the control electrode of the driver transistor.

8. The pixel compensation circuit according to claim 1, wherein the storage module comprises: a capacitor, wherein:

the capacitor comprises a first terminal connected with the first power supply terminal D, and a second terminal connected with the control electrode of the driver transistor.

9. The pixel compensation circuit according to claim 1, wherein the light-emission control module comprises: a second switch transistor, wherein:

the second switch transistor comprises a control electrode connected with the light-emission control signal terminal, a first electrode connected with the second electrode of the driver transistor, and a second electrode connected with a first terminal of the light-emitting element, and the second terminal of the light-emitting element is connected with a second power supply terminal.

10. An organic light-emitting diode display panel, comprising the pixel compensation circuit according to claim 1.

11. A display device, comprising the organic light-emitting diode display panel according to claim 10.

* * * * *